US008943718B2

(12) United States Patent
Ruvang

(10) Patent No.: US 8,943,718 B2
(45) Date of Patent: Feb. 3, 2015

(54) ATTACHMENT OF WEAR MEMBER TO LIP OF EXCAVATION IMPLEMENT

(71) Applicant: Black Cat Blades Ltd., Edmonton, CA (US)

(72) Inventor: John A. Ruvang, Bartonville, TX (US)

(73) Assignee: Black Cat Blades Ltd., Edmonton, Alberta (CA)

( * ) Notice: Subject to any disclaimer, the term of this patent is extended or adjusted under 35 U.S.C. 154(b) by 65 days.

(21) Appl. No.: 13/746,451

(22) Filed: Jan. 22, 2013

(65) Prior Publication Data

US 2014/0202049 A1 Jul. 24, 2014

(30) Foreign Application Priority Data

Feb. 13, 2012 (WO) ..... PCT/US12/24843

(51) Int. Cl.
*E02F 9/28* (2006.01)

(52) U.S. Cl.
CPC ..... *E02F 9/2841* (2013.01); *E02F 9/2883* (2013.01)
USPC ..... 37/458

(58) Field of Classification Search
CPC ..... E02F 9/2816; E02F 9/2825; E02F 9/2833; E02F 9/2841; E02F 9/2866
USPC ..... 37/446–460; 403/374.3, 374.4, 374.1, 403/379.3, 379.4
See application file for complete search history.

(56) References Cited

U.S. PATENT DOCUMENTS

| | | | | |
|---|---|---|---|---|
| 2,167,425 | A | 7/1939 | Page | |
| 3,371,437 | A | 3/1968 | Wilson et al. | |
| 4,748,754 | A | 6/1988 | Schwappach | |
| 5,713,145 | A | 2/1998 | Ruvang | |
| 6,209,238 | B1 * | 4/2001 | Ruvang | 37/455 |
| 6,240,663 | B1 | 6/2001 | Robinson | |
| 6,729,052 | B2 * | 5/2004 | Ollinger et al. | 37/452 |
| 7,219,454 | B2 | 5/2007 | Maher | |
| 7,472,503 | B2 * | 1/2009 | Maher | 37/455 |
| 8,438,760 | B2 * | 5/2013 | Maher et al. | 37/457 |
| 2003/0061744 | A1 | 4/2003 | Leslie et al. | |
| 2005/0229441 | A1 | 10/2005 | Maher | |

FOREIGN PATENT DOCUMENTS

AU 2003264586 A1 7/2004

OTHER PUBLICATIONS

International Search Report with Written Opinion issued Oct. 29, 2012 for PCT Patent Application No. PCT/US12/024843, 10 pages.

* cited by examiner

*Primary Examiner* — Robert Pezzuto
(74) *Attorney, Agent, or Firm* — Smith IP Services, P.C.

(57) ABSTRACT

An attachment system for use with an excavation implement can include a retainer which secures a wear member to a lip of the excavation implement, the retainer being fixedly attached to the lip, and a biasing device retained within the retainer. The biasing device biases the wear member toward the lip. A method of attaching a wear member to a lip of an excavation implement can include installing a biasing device in a retainer fixedly secured to the lip, and then positioning the wear member on the lip. Another attachment system can include a biasing device which is compressed between the retainer and the locking device. Another method of attaching a wear member can include positioning the wear member on the lip, then extending the locking device from the wear member, and then compressing the biasing device between the locking device and the retainer.

28 Claims, 6 Drawing Sheets

ATTACHMENT OF WEAR MEMBER TO LIP OF EXCAVATION IMPLEMENT

CROSS-REFERENCE TO RELATED APPLICATION

This application claims the benefit under 35 USC §119 of the filing date of International Application Serial No. PCT/US12/24843 filed 13 Feb. 2012. The entire disclosure of this prior application is incorporated herein by this reference.

BACKGROUND

This disclosure relates generally to equipment utilized and operations performed in conjunction with excavation implements and, in one example described below, more particularly provides for improved attachment of a wear member to a lip of an excavation implement.

A lip of an excavation implement can become damaged or worn, due to engagement with material being excavated. It is important to protect the lip from wear, and so it is common practice to attach wear members to a forward edge of the lip. It will be appreciated that improvements are continually needed in the art of attaching wear members to lips of excavation implements.

SUMMARY

In this disclosure, systems and methods are provided which bring improvements to the art of attaching wear members to lips of excavation implements. One example is described below in which a biasing device maintains a wear member resiliently against a lip. Another example is described below in which a fastener is threaded through a locking device to compress the biasing device.

An attachment system for use with an excavation implement is described below. In one example, the system can include a retainer which secures a wear member to a lip of the excavation implement, with the retainer being fixedly attached to the lip. A biasing device is retained within the retainer. The biasing device biases the wear member toward the lip.

A method of attaching a wear member to a lip of an excavation implement is also provided to the art. The method can include installing a biasing device in a retainer fixedly secured to the lip, and then positioning the wear member on the lip.

Another attachment system is described below. In an example, a retainer which secures a wear member to a lip of the excavation implement is fixedly attached to the lip. A biasing device biases the wear member toward the lip. A locking device extends through the wear member. The biasing device is compressed between the retainer and the locking device.

Another method of attaching a wear member to a lip of an excavation implement can include the steps of: positioning the wear member on the lip, then extending a locking device from the wear member, and then compressing a biasing device between the locking device and a retainer fixedly secured to the lip.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
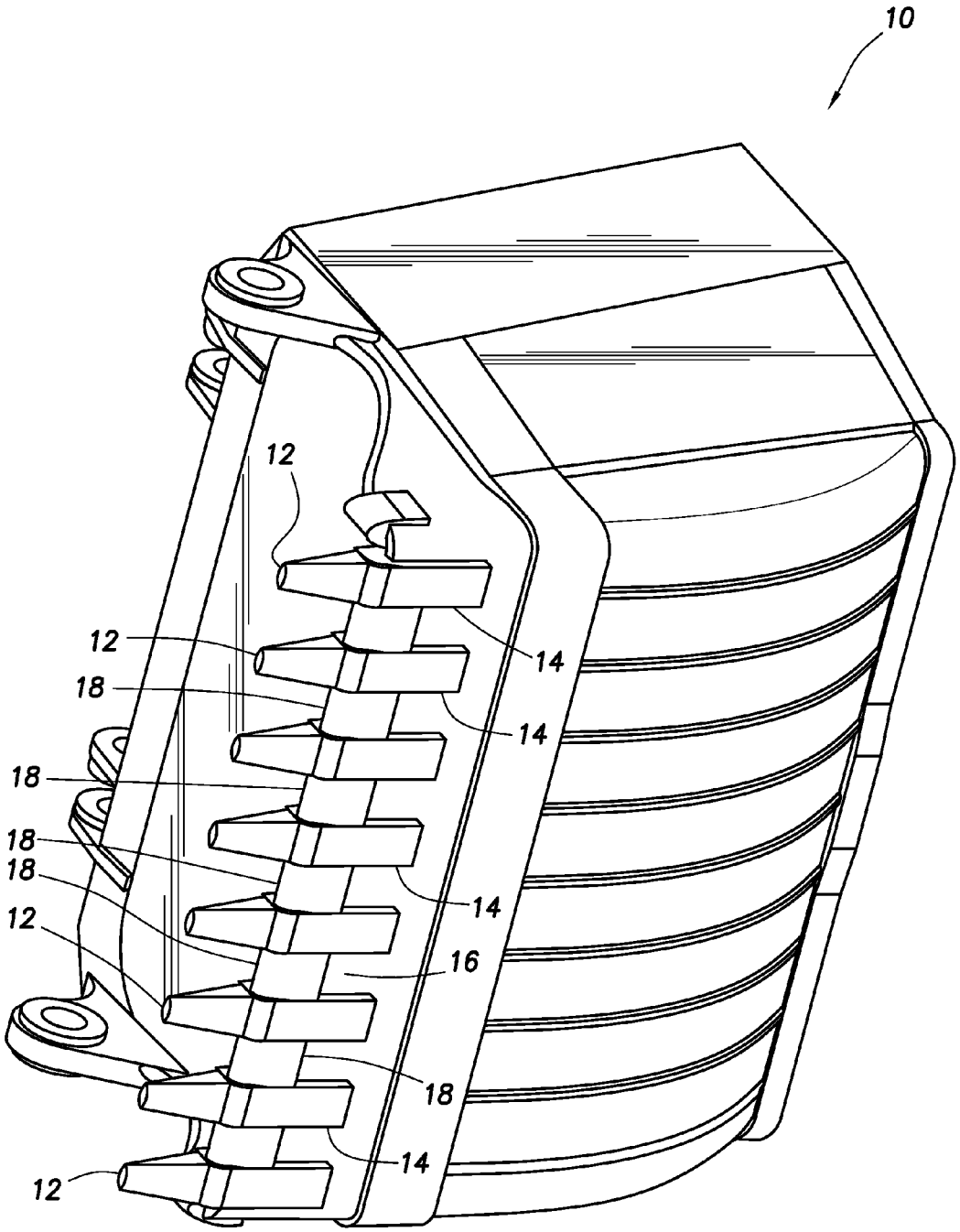
FIG. 1 is a representative oblique view of an excavation implement which can embody principles of this disclosure.

Representatively illustrated in FIG. 1 is an excavation implement 10 and associated method which can embody principles of this disclosure. However, it should be clearly understood that the implement 10 and method are merely one example of an application of the principles of this disclosure in practice, and a wide variety of other examples are possible. Therefore, the scope of this disclosure is not limited at all to the details of the implement 10 and method described herein and/or depicted in the drawings.

In the example of FIG. 1, the implement 10 is of the type known as a "dipper" or "bucket" of a cable shovel, but it should be clearly understood that the principles of this disclosure can be utilized with other types of excavation implements. Indeed, the principles of this disclosure could be used to improve the attachment of wear members to any type of excavation implement.

In the illustration of FIG. 1, the implement 10 is rotated so that an earth-engaging side of the implement is clearly visible. From this perspective, it may be seen that multiple teeth 12 are mounted on the implement 10 for piercing the earth.

These teeth 12 are typically rapidly worn down or otherwise damaged during use of the implement 10, and so replacement of the teeth should be conveniently, economically, rapidly and safely accomplished. These objectives are obtained by use of specially configured adapters 14 which releasably secure the teeth 12 to a forward edge of a lip 16 of the implement 10.

The adaptors 14 are examples of wear members that protect the earth-engaging lip 16 of the implement 10. Other examples of wear members include shrouds 18, which wrap around the forward edge of the lip 16 between the adaptors 14. In yet another example, the teeth 12 can be attached to the lip 16, without use of the separate adaptors 14, in which case the teeth can themselves serve as wear members for protection of the lip. Any type of wear member can be used, in keeping with the scope of this disclosure.

Figure 2:
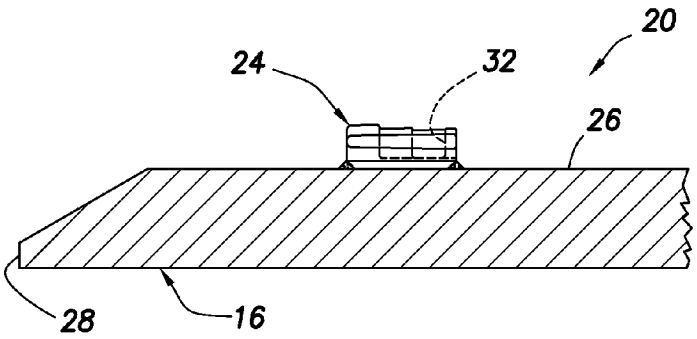
Figure 3:
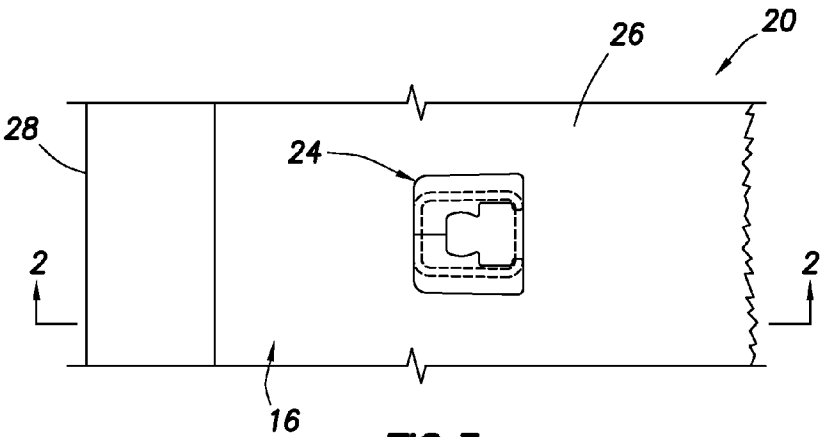

Referring additionally now to FIGS. 2 & 3, an attachment system 20 and associated method are representatively illustrated for attaching a wear member to a lip of an excavation implement. The system 20 is described below as being used for attaching a wear member 22 (not shown in FIGS. 2 & 3, see FIGS. 6-11) to the implement 10, but it should be clearly understood that the system can be used for attaching other types of wear members to lips of other types of excavation implements, and so the scope of this disclosure is not limited at all to the details of the system as depicted in the drawings and described below.

In FIGS. 2 & 3, an initial step of fixedly securing a retainer 24 to the lip 16 is depicted. In this example, the retainer 24 is secured to an upper side 26 of the lip 16, spaced away from a forward earth-engaging edge 28 of the lip.

In other examples, more than one retainer 24 could be used, the retainer could be secured to a lower or vertical side of the lip 16, the retainer could be secured at or to the forward edge 28, etc. Thus, the details of the retainer 24 and its positioning on the lip 16 can be varied, in keeping with the scope of this disclosure.

The retainer 24 may be secured to the lip 16 by welding, by use of fasteners (such as, bolts, rivets, etc.), or by any other suitable means. Preferably, the retainer 24 is fixedly secured to the lip 16, so that it can resist forces applied during excavation operations. A technique for attaching the retainer 24 to the lip 16 should be selected based on expected excavation conditions for a certain application.

Figure 4:
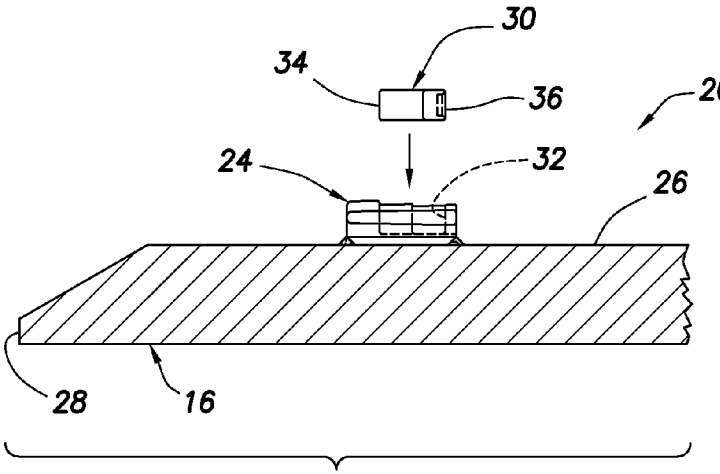
FIGS. 2-10 are representative views of an attachment system and steps in a method of attaching a wear member to a lip of the excavation implement, which attachment system and method can embody principles of this disclosure.
Figure 5:
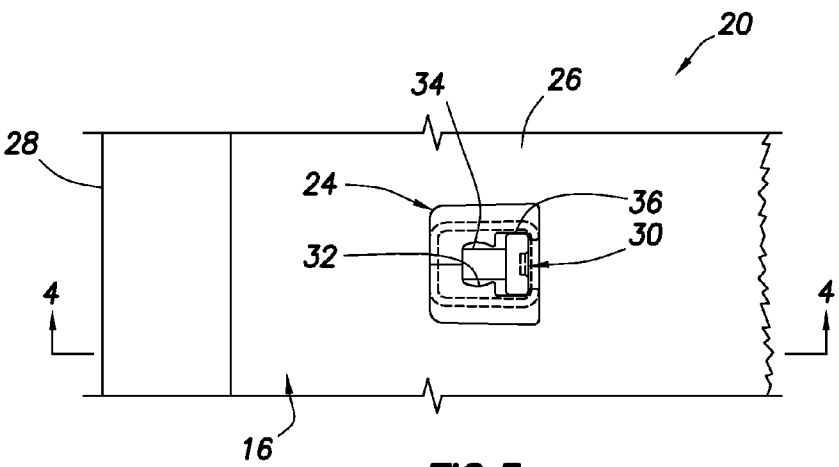

Referring additionally now to FIGS. 4 & 5, a biasing device 30 is installed in the retainer 24. In this example, the biasing device 30 is retained within a recess 32 formed in the retainer 24. In this manner, the biasing device 30 is protected within the retainer 24 during excavation operations. However, in other examples, the biasing device 30 may not be retained within the retainer 24.

The biasing device 30 in this example includes a resilient elastomer (such as rubber, etc.) member 34 and a plate 36 for compressing the resilient member against the retainer 24. This compression of the resilient member 34 applies a biasing force to retain the wear member 22 against the forward edge 28 of the lip 16, as described more fully below.

Figure 6:
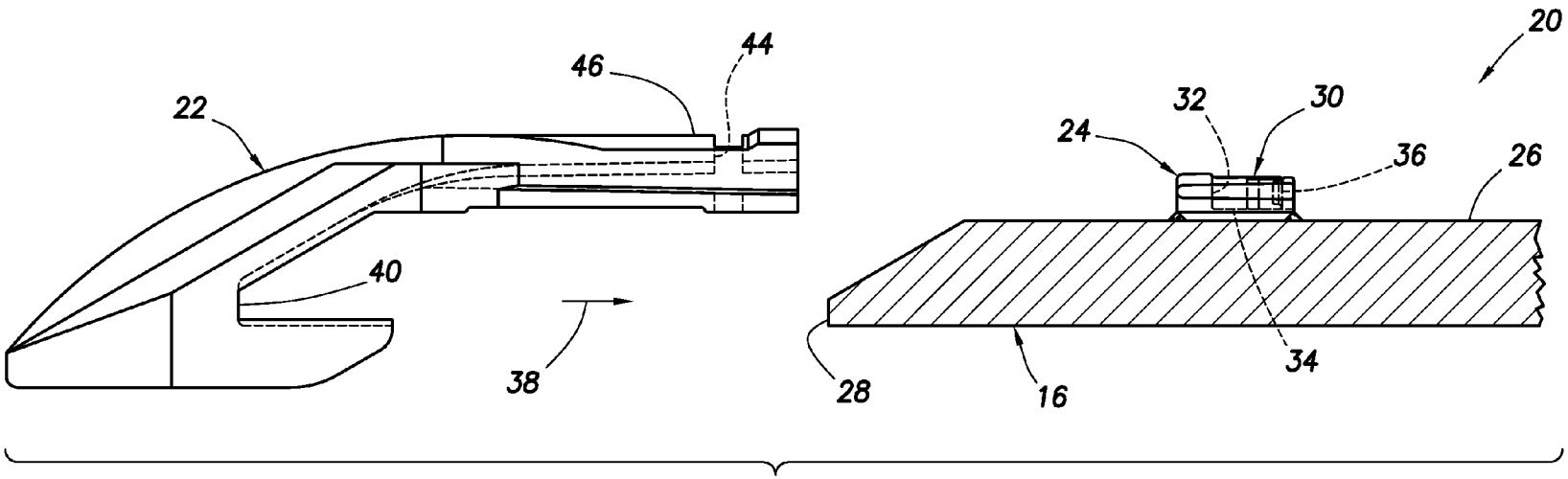

Referring additionally now to FIG. 6, the wear member 22 is representatively illustrated as being installed onto the lip 16. In this example, the wear member 22 comprises an earth-engaging tooth, but in other examples, the wear member could comprise an adaptor, a shroud, or any other type of wear member.

It is desired that, after the wear member 22 is positioned on the lip 16, the wear member will be continually biased into contact with the forward edge 28 of the lip, in order to mitigate wear between the wear member and the lip during excavation operations. For this purpose, the biasing device 30 is used to bias the wear member 22 in a direction 38 toward the lip 16, as described more fully below.

In this example, it is desired to maintain contact between the forward edge 28 and a generally C-shaped recess 40 in the wear member 22. However, in other examples, the forward edge 28 and recess 40 may be otherwise shaped, engagement may be maintained between other surfaces on the wear member 22 and the lip 16, etc.

Figure 7:
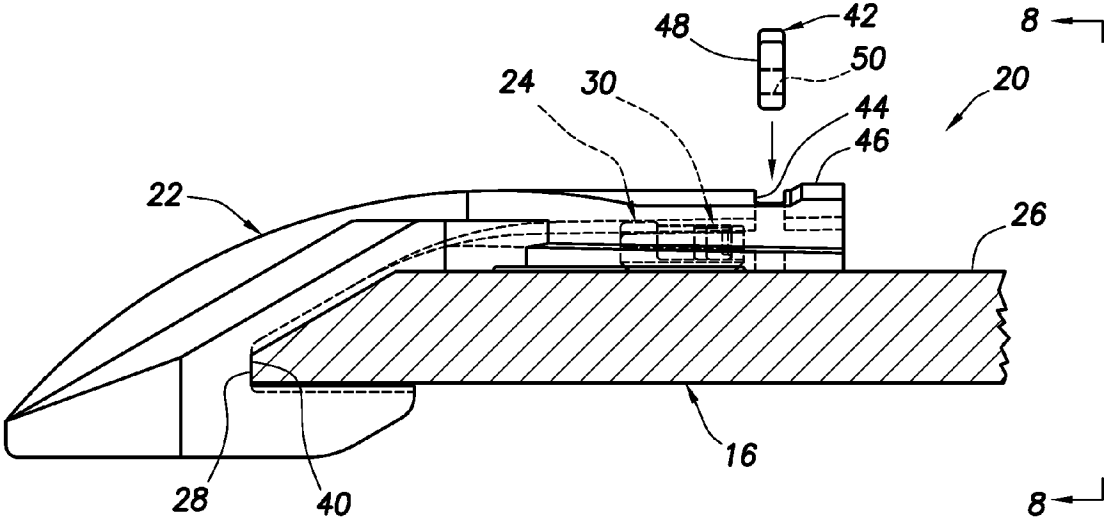
Figure 8:
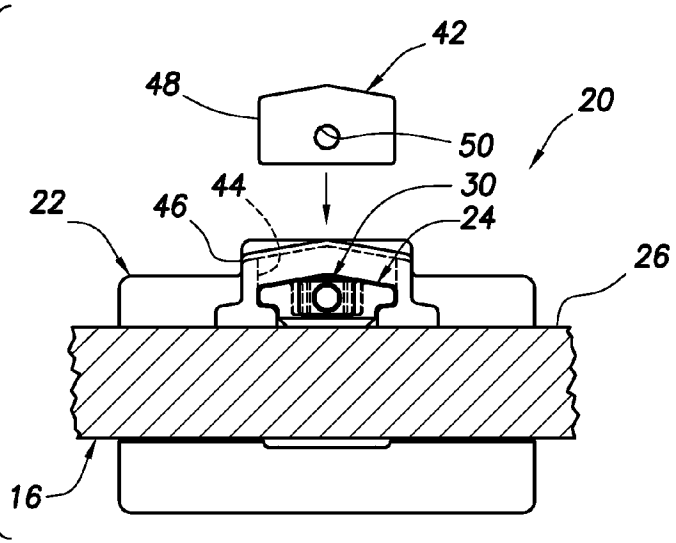

Referring additionally now to FIGS. 7 & 8, a locking device 42 is being installed through an opening 44 formed through an upper wall 46 of the wear member 22. In this example, the locking device 42 comprises a flat plate 48 having a threaded opening 50 extending through the plate. However, other configurations may be used for the locking device 42, in keeping with the scope of this disclosure.

Figure 9:
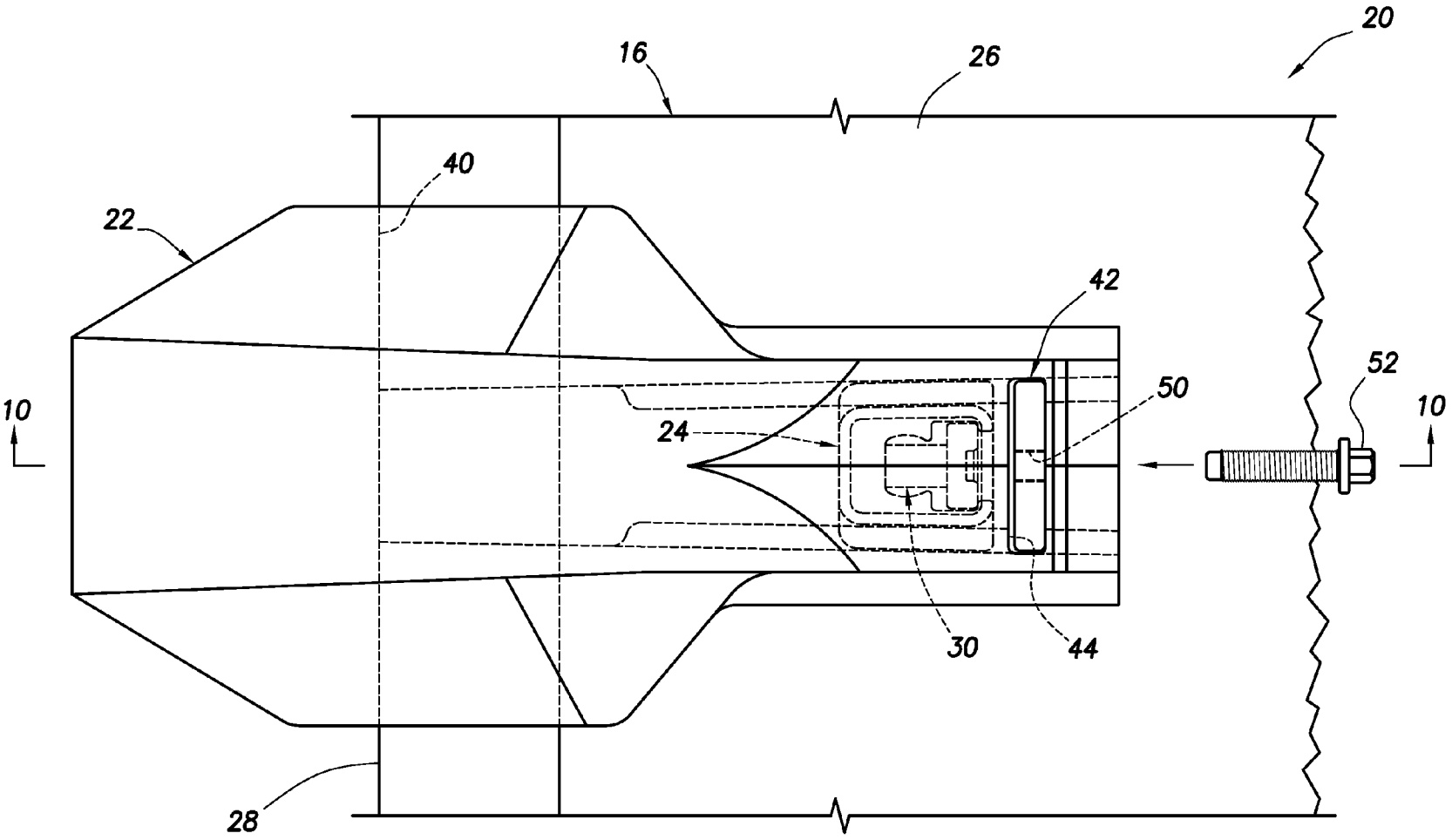

Referring additionally now to FIG. 9, the system 20 is depicted after the locking device 42 has been inserted in the opening 44, and a fastener 52 is being installed. In this example, the fastener 52 is threaded through the opening 50 to compress the biasing device 30. However, in other examples the biasing device 30 could be compressed by other means, in keeping with the scope of this disclosure.

Figure 10:
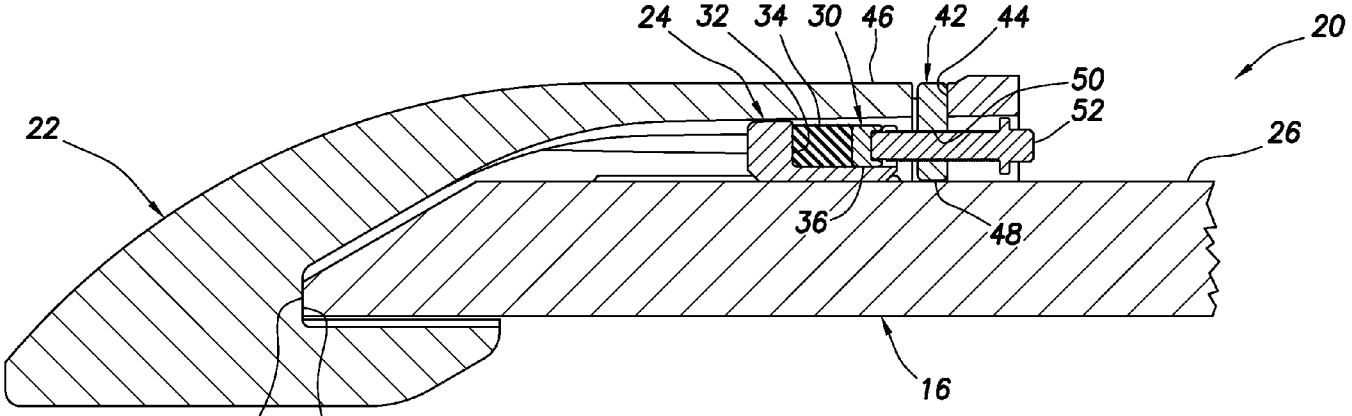

Referring additionally now to FIG. 10, the system 20 is depicted after the fastener 52 has been threaded sufficiently far through the locking device 42 to contact the plate 36 and compress the resilient member 34. This compression of the biasing device 30 applies a rearward-directed biasing force to the fastener 52 and via the locking device 42 to the wear member 22. Thus, the wear member 22 is biased toward the lip 16 by the biasing device 30.

Note that, even if the fastener 52 should inadvertently be lost during an excavating operation, the locking device 42 can still abut the retainer 24 and prevent removal of the wear member 22 from the lip 16. Thus, the wear member 22 can remain on the lip 16 until the fastener 52 is replaced. However, it is anticipated that the residual biasing force exerted by the biasing device 30 on the fastener 52 will prevent the fastener from unthreading from the locking device 42.

Note that the fastener 52 is compressed in the area between the locking device 42 and the biasing device 30. The biasing device 30 is compressed between the locking device 42 and the retainer 24, or more precisely, between the fastener 52 and the retainer 24.

Figure 11:
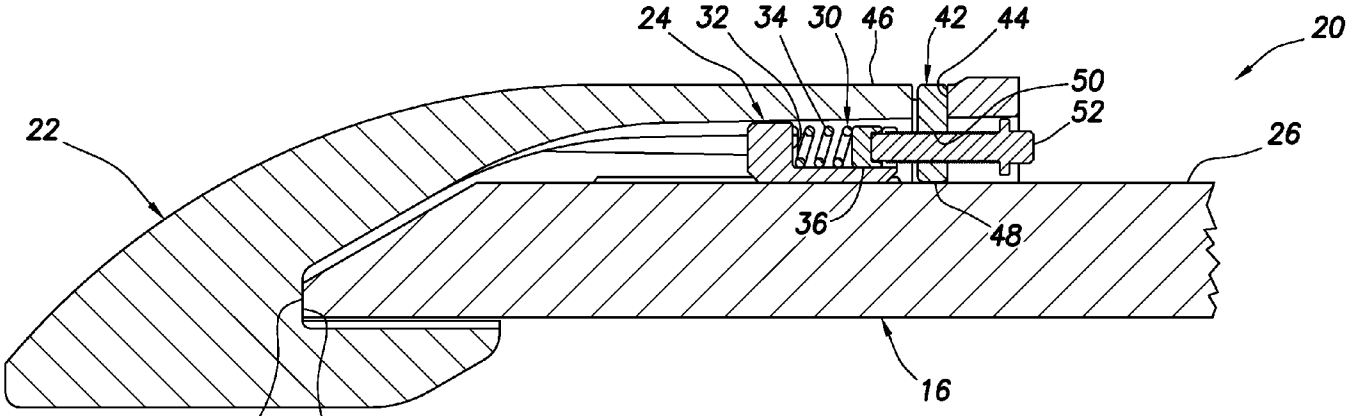
FIG. 11 is a representative cross-sectional view of another example of the attachment system.

In FIG. 11, another example of the system 20 is representatively illustrated. In this example, the resilient member 34 of the biasing device 30 is in the form of a spiral compression spring. Other types of springs, and other types of resilient members may be used in the biasing device 30 in keeping with the principles of this disclosure.

Furthermore, it is not necessary for the biasing device 30 to include the resilient member 34, since a biasing force can be exerted using other means. For example, a pressurized gas chamber, a shape memory alloy, or any other element could exert the biasing force in the biasing device 30.

It may now be fully appreciated that the above disclosure provides significant advancements to the art of attaching wear members to lips of excavator implements. In the system 20, the wear member 22 can be conveniently attached to the lip 16 of the implement 10 using the biasing device 30 which is retained within the retainer 24. The fastener 52 threaded through the locking device 42, in cooperation with the retainer 24 and biasing device 30, resiliently retains the wear member 22 on the lip 16, with the recess 40 of the wear member maintained in contact with the forward edge 28 of the lip.

An attachment system 20 for use with an excavation implement 10 is described above. In one example, the system 20 comprises a retainer 24 which secures a wear member 22 to a lip 16 of the excavation implement 10. The retainer 24 is fixedly attached to the lip 16. A biasing device 30 is retained within the retainer 24. The biasing device 30 biases the wear member 22 toward the lip 16.

The biasing device 30 may be compressed in response to installation of a fastener 52 through a locking device 42 which extends inwardly from the wear member 22. The fastener 52 may be threaded through the locking device 42.

The fastener 52 may be compressed between the locking device 42 and the biasing device 30. The biasing device 30 may be compressed between the locking device 42 and the retainer 24.

The fastener 52 may be compressed between the retainer 24 and the locking device 42. The biasing device 30 may be compressed between the retainer 24 and a locking device 42 which extends from the wear member 22.

The system 20 can include a locking device 42 which extends from the wear member 22 and abuts the retainer 24, thereby preventing removal of the wear member 22 from the lip 16.

A method of attaching a wear member 22 to a lip 16 of an excavation implement 10 is also described above. In one example, the method can include: installing a biasing device 30 in a retainer 24 fixedly secured to the lip 16; and then positioning the wear member 22 on the lip 16.

The method can include extending a locking device 42 from the wear member 22, after positioning the wear member 22 on the lip 16. The locking device 42 may prevent removal of the wear member 22 from the lip 16 by abutting the retainer 24.

The method can also include compressing the biasing device 30, thereby biasing the wear member 22 toward the lip 16. The compressing can comprise compressing the biasing device 30 between the retainer 24 and the locking device 42, and/or compressing a fastener 52 between the locking device 42 and the biasing device 30.

Compressing the biasing device 30 can comprise installing the fastener 52, thereby securing the locking device 42. Installing the fastener 52 can comprise threading the fastener 52 through the locking device 42, and/or compressing the fastener 52.

Another attachment system 20 for use with an excavation implement 10 can include a retainer 24 which secures a wear member 22 to a lip 16 of the excavation implement 10, the retainer 24 being fixedly attached to the lip 16; a biasing device 30 which biases the wear member 22 toward the lip 16; and a locking device 42 which extends from the wear member 22. The biasing device 30 is compressed between the retainer 24 and the locking device 42.

The biasing device 30 can be retained within the retainer 24. The locking device 42 can abut the retainer 24 and thereby prevent removal of the wear member 22 from the lip 16.

The biasing device 30 can be compressed in response to installation of a fastener 52 through the locking device 42. The fastener 52 may be threaded through the locking device 42.

Another method of attaching a wear member 22 to a lip 16 of an excavation implement 10 can comprise: positioning the wear member 22 on the lip 16; then extending a locking device 42 from the wear member 22; and then compressing a biasing device 30 between the locking device 42 and a retainer 24 fixedly secured to the lip 16.

The method can include installing the biasing device 30 in the retainer 24. Installing the biasing device 30 may be performed prior to positioning the wear member 22 on the lip 16.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa.

Accordingly, the foregoing detailed description is to be clearly understood as being given by way of illustration and example only, the spirit and scope of the invention being limited solely by the appended claims and their equivalents.

What is claimed is:

1. An attachment system for use with an excavation implement, the system comprising:

a retainer which secures a wear member to a lip of the excavation implement, the retainer being fixedly attached to the lip; and a biasing device, wherein the biasing device is installed within a recess formed in the retainer prior to positioning the wear member on the lip, and wherein the biasing device biases the wear member toward the lip after the wear member is secured to the lip.

2. The system of claim 1, wherein the biasing device is compressed in response to installation of a fastener through a locking device which extends from the wear member.

3. The system of claim 2, wherein the fastener is threaded through the locking device.

4. The system of claim 2, wherein the fastener is compressed between the locking device and the biasing device.

5. The system of claim 2, wherein the biasing device is compressed between the locking device and the retainer.

6. The system of claim 2, wherein the fastener is compressed between the retainer and the locking device.

7. The system of claim 1, wherein the biasing device is compressed between the retainer and a locking device which extends from the wear member.

8. The system of claim 1, further comprising a locking device which extends from the wear member, and wherein the locking device abuts the retainer and thereby prevents removal of the wear member from the lip.

9. A method of attaching a wear member to a lip of an excavation implement, the method comprising:

installing a biasing device in a recess in a retainer fixedly secured to the lip;

then positioning the wear member on the lip; and then extending a locking device from the wear member.

10. The method of claim 9, wherein the locking device prevents removal of the wear member from the lip by abutting the retainer.

11. The method of claim 9, further comprising compressing the biasing device, thereby biasing the wear member toward the lip.

12. The method of claim 11, wherein the compressing comprises compressing the biasing device between the retainer and the locking device.

13. The method of claim 11, wherein the compressing comprises installing a fastener, thereby securing the locking device.

14. The method of claim 13, wherein the installing comprises threading the fastener through the locking device.

15. The method of claim 13, wherein the installing further comprises compressing the fastener between the locking device and the biasing device.

16. An attachment system for use with an excavation implement, the system comprising:

a retainer which secures a wear member to a lip of the excavation implement, the retainer being fixedly attached to the lip;

a biasing device, wherein the biasing device is installed within a recess formed in the retainer prior to positioning the wear member on the lip, and wherein the biasing device biases the wear member toward the lip after the wear member is secured to the lip; and a locking device which extends from the wear member, wherein the biasing device is compressed between the retainer and the locking device.

17. The system of claim 16, wherein the biasing device is retained within the retainer.

18. The system of claim 16, wherein the locking device abuts the retainer and thereby prevents removal of the wear member from the lip.

19. The system of claim 16, further comprising a fastener which is threaded into the locking device.

20. The system of claim 19, wherein the biasing device is compressed in response to rotation of the fastener relative to the locking device.

21. The system of claim 20, wherein the fastener is compressed between the locking device and the biasing device.

22. The system of claim 20, wherein the fastener is compressed between the retainer and the locking device.

23. A method of attaching a wear member to a lip of an excavation implement, the method comprising:

installing a biasing device within a recess formed in a retainer fixedly secured to the lip;

then positioning the wear member on the lip;

then extending a locking device from the wear member; and then compressing the biasing device between the locking device and the retainer.

24. The method of claim 23, wherein the locking device prevents removal of the wear member from the lip by abutting the retainer.

25. The method of claim 23, wherein the compressing biases the wear member toward the lip.

26. The method of claim 23, wherein the compressing comprises installing a fastener, thereby securing the locking device.

27. The method of claim 26, wherein the installing comprises threading the fastener through the locking device.

28. The method of claim 26, wherein the installing further comprises compressing the fastener between the locking device and the biasing device.

* * * * *